US009862202B2

(12) United States Patent
Uezawa

(10) Patent No.: US 9,862,202 B2
(45) Date of Patent: Jan. 9, 2018

(54) LIQUID EJECTING HEAD AND LIQUID EJECTING APPARATUS

(71) Applicant: SEIKO EPSON CORPORATION, Tokyo (JP)

(72) Inventor: Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/465,198

(22) Filed: Mar. 21, 2017

(65) Prior Publication Data

US 2017/0274670 A1 Sep. 28, 2017

(30) Foreign Application Priority Data

Mar. 22, 2016 (JP) ..... 2016-057129

(51) Int. Cl.
*B41J 2/19* (2006.01)
*B41J 2/175* (2006.01)

(52) U.S. Cl.
CPC ..... *B41J 2/19* (2013.01); *B41J 2/17563* (2013.01)

(58) Field of Classification Search
CPC ..... B41J 2/19; B41J 2/17563
See application file for complete search history.

(56) References Cited

U.S. PATENT DOCUMENTS 7,014,303 B2 * 3/2006 Matsushita ..... B41J 2/19 347/85
8,662,634 B2 * 3/2014 Katoh ..... B41J 2/16532 347/30
9,162,471 B2 * 10/2015 Kida ..... B41J 2/17596
2002/0109762 A1 8/2002 Usui et al.

FOREIGN PATENT DOCUMENTS

JP 11-020186 A 1/1999
JP 2006-069168 A 3/2006
JP 2008-119962 A 5/2008
JP 2008-179071 A 8/2008

* cited by examiner

*Primary Examiner* — Lamson Nguyen
(74) *Attorney, Agent, or Firm* — Foley & Lardner LLP

(57) ABSTRACT

A liquid introduction member includes an inlet into which a liquid is introduced, a filter to filter the liquid introduced from the inlet, a filter chamber in which cross-sectional areas of the flow path increase from the inlet side to the filter side, and a supply flow path to supply the liquid that has passed through the filter to the nozzle side. The filter chamber has at least one guide extending from an inner wall surface of the filter chamber toward the inlet with a space between the guide and the filter, a bottom surface of the guide has a guide surface to guide bubbles which have entered from the inlet, and the guide guides the bubbles into the space by use of the guide surface to spread the bubbles onto the filter toward an outer periphery of the filter.

16 Claims, 9 Drawing Sheets

LIQUID EJECTING HEAD AND LIQUID EJECTING APPARATUS

BACKGROUND

1. Technical Field

The present invention relates to a liquid ejecting head that has a filter for filtering liquid, and a liquid ejecting apparatus including the liquid ejecting head.

2. Related Art

A liquid ejecting apparatus includes a liquid ejecting head and ejects (discharges) various kinds of liquids from the liquid ejecting head. Examples of the liquid ejecting apparatus include image recording apparatuses such as ink jet printers and ink jet plotters. Such liquid ejecting apparatuses can accurately eject very small amounts of liquid at predetermined positions and have been used in various manufacturing apparatuses. Such applications include, for example, display manufacturing apparatuses for manufacturing color filters for liquid crystal displays, electrode forming apparatuses for forming electrodes for organic electroluminescence (EL) displays and field emission displays (FEDs), and chip manufacturing apparatuses for manufacturing biochips (biochemical chips). A recording head for the image recording apparatuses ejects liquid ink, and a color material ejecting head for display manufacturing apparatuses ejects solutions of individual red (R), green (G), and blue (B) coloring materials. An electrode material ejecting head for the electrode forming apparatus ejects a liquid electrode material, and a bioorganic compound ejecting head for the chip manufacturing apparatus ejects a solution of bioorganic compounds.

These liquid ejecting heads introduce a liquid from a liquid supply source that stores the liquid and drive a drive element such as a piezoelectric element, a heating element, or the like to eject the ink from a nozzle in the form of droplets. Some of the liquid ejecting heads employ a mechanism to filter the introduced liquid to capture foreign matter and bubbles contained in the liquid by using a filter. In a liquid flow path, a portion where the filter is placed has a cross-sectional area that is larger than that of other portions of the flow path, and this portion forms a space (hereinafter, referred to as a filter chamber). In the filter chamber, rib-shaped protrusions may be provided, for example, to increase the flow rate of the liquid flowing toward the filter or to provide a path that enables the liquid to pass through the filter even if bubbles are partly covering the filter (for example, see JP-A-2006-69168).

In order to increase the degree of bubble discharging in a maintenance operation (cleaning operation) for discharging bubbles on the upstream side of a filter by applying a negative pressure to a nozzle surface having a nozzle of a liquid ejecting head or by applying a pressure to a liquid flowing in a flow path, it is preferable that the bubbles cover the entire filter and clog the filter. However, the above-mentioned ribs may prevent the bubbles from sufficiently spreading onto the filter and may cause a reduction in the degree of bubble discharging.

SUMMARY

An advantage of some aspects of the invention is that there is provided a liquid ejecting head and liquid ejecting apparatus capable of increasing the degree of discharge of bubbles on a filter.

According to an aspect of the invention, a liquid ejecting head for introducing via a liquid introduction member a liquid into a liquid flow path communicating with a nozzle and for ejecting the liquid introduced into the liquid flow path from the nozzle is provided. The liquid introduction member includes an inlet into which the liquid is introduced, a filter to filter the liquid introduced from the inlet, a filter chamber in which cross-sectional areas of the flow path increase from the inlet side to the filter side, and a supply flow path to supply the liquid that has passed through the filter to the nozzle side. The filter chamber has at least one guide extending from an inner wall surface of the filter chamber toward the inlet with a space between the guide and the filter, a bottom surface of the guide has a guide surface to guide bubbles which have entered from the inlet, and the guide guides the bubbles into the space by using the guide surface to spread the bubbles onto the filter toward an outer periphery of the filter.

According to this aspect, bubbles are guided by the guide surface into the space between the guide and the filter and spread onto the filter toward the outer periphery of the filter, and thereby the degree of bubble discharging in a maintenance operation can be increased. In other words, when the ink flow rate of the liquid in the liquid flow path is increased during the maintenance operation, the guide can guide the bubbles into the space between the guide and the filter by using the guide surface and spread the bubbles onto the filter to cover the filter. This spreading produces a large pressure difference between the upstream side and the downstream side. Due to the pressure difference, the bubbles can be efficiently discharged in a short time.

In the above-described structure, it is preferable that the guide surface be inclined from the inlet side toward the outer periphery of the filter, and that the average distance between the guide surface and the filter in the guide-extending direction be larger than the average distance between an area other than the guide surface in the bottom surface of the guide and the filter in the guide-extending direction.

In this structure, the guide surface is inclined from the inlet side toward the outer periphery of the filter. Accordingly, this inclination enables the bubbles to be guided from the inlet side toward the outer periphery of the filter as a result of the liquid flowing from the inlet side. Furthermore, the average distance between an area other than the guide surface and the filter is shorter than the average distance between the guide surface and the filter. Accordingly, the bubbles that have been guided into the space can be pressed against the filter, and thereby the degree of bubble discharging can be further increased.

In the above-described structure, it is preferable that the area other than the guide surface in the bottom surface of the guide be parallel to the filter.

With this structure, the bubbles that have been guided into the space can be further evenly pressed against the filter, and thereby the degree of bubble discharging can be further increased.

In the above-described structure, it is preferable that the guides be disposed at different locations along a peripheral edge of the inlet.

With this structure, the bubbles guided by the guides into the spaces can be further evenly pressed against the filter, and thereby the degree of bubble discharging can be further increased.

In the above-described structure, the guides may include first guides that are relatively long in the guide-extending direction and second guides that are relatively short in the guide-extending direction, and the second guides may be disposed between the adjacent first guides.

With this structure, for example, when the flow-path cross-sectional area of the filter chamber is larger than flow-path cross-sectional areas of the other portions in the ink flow path and larger spaces are defined between the adjacent first guides in the filter chamber, the second guides are disposed in the spaces. Accordingly, when bubbles are spread onto the filter, the second guides press the bubbles against the filter together with the first guides, and the bubbles are evenly spread onto the filter. As a result, the degree of bubble discharging can be increased.

In the above-described structure, it is preferable that the locations of the bottom surfaces of the second guides be aligned with the locations of the bottom surfaces of the first guides in a direction orthogonal to the filter.

With this structure, the bottom surfaces of the second guides are not closer than the bottom surfaces of the first guides to the filter, and the distances from the bottom surfaces of the second guides to the filter are not excessive. Accordingly, when bubbles are spread onto the filter, the second guides can be suppressed from interfering with the movement of the bubbles, and the bubbles can be prevented from floating away from the filter, and thereby the bubbles can be evenly spread onto the filter. As a result, the degree of bubble discharging can be increased.

In the above-described structure, the filter may have an elliptical shape, and dimensions of the guide surfaces in the guide-extending direction may be larger in the guides disposed on the inner wall surface where the distances to the inlet are longer.

With this structure, the guides that are disposed on the inner wall surface where the distances to the inlet are longer have larger dimensions in the guide surfaces in the direction the guides extend. Accordingly, during the maintenance operation, bubbles can easily enter the spaces between the guides that have larger dimensions and the filter. Consequently, the bubbles can be evenly spread onto the filter, and the degree of bubble discharging can be increased.

In the above-described structure, the inlet may be off-centered with respect to a central part of the filter, and dimensions of the guide surfaces in the guide-extending direction may be larger in the guides disposed on the inner wall surface where the distances to the inlet are shorter.

With this structure, the dimensions of the guide surfaces in the guide-extending direction are larger in the guides that are disposed on the inner wall surface of the filter chamber where distances to the inlet are shorter. Consequently, during the maintenance operation, this structure enables bubbles to enter the spaces between the guides that are disposed at the locations on the inner wall surface where distances to the inlet are shorter and prevents the bubbles from collecting in areas where the flow tends to stagnate on the side opposite to the side where the inlet is off-centered with respect to the filter. As a result, the degree of bubble discharging can be increased.

A liquid ejecting apparatus according to an aspect of the invention includes the liquid ejecting head according to any one of the above-described liquid ejecting heads, and a maintenance mechanism for discharging the liquid and bubbles from the nozzle of the liquid ejecting head.

With this structure, the degree of bubble discharging during a maintenance operation can be increased, and the amount of liquid consumed in the maintenance operation can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the present invention will be described with reference to the attached drawings. Although various limitations are made in the embodiments described hereinafter in order to illustrate a specific preferred example of the invention, it should be noted that the scope of the invention is not intended to be limited to these embodiments unless such limitations are explicitly mentioned hereinafter. In the description below, as an example liquid ejecting apparatus according to an embodiment of the invention, an ink jet recording apparatus (hereinafter, referred to as a printer) including an ink jet recording head (hereinafter, referred to as a recording head) that is a kind of liquid ejecting head will be described.

Figure 1:
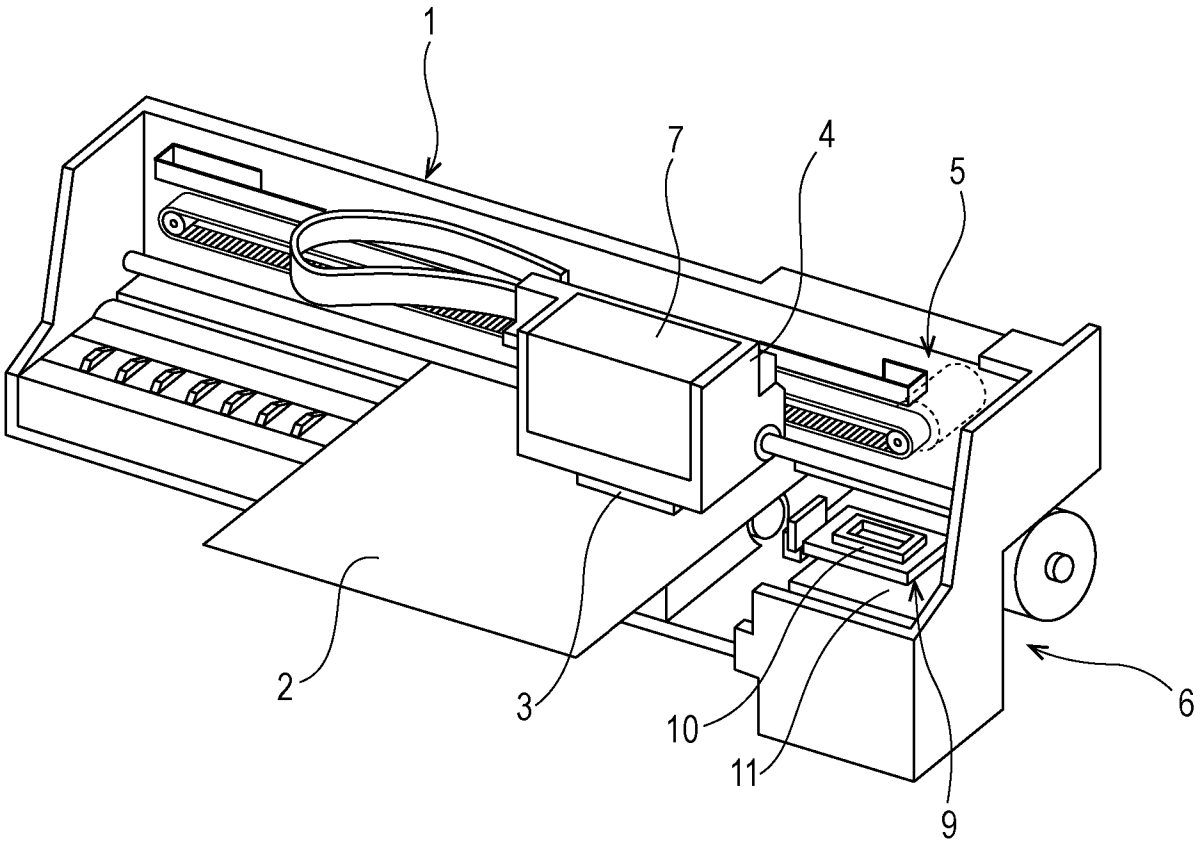
FIG. 1 is a schematic structural view of a liquid ejecting apparatus (printer).

FIG. 1 is a perspective view illustrating a structure of a printer 1. The printer 1 is an apparatus that records, for example, an image onto a surface of a recording medium 2 (a target on which ink droplets are ejected) such as recording paper by ejecting liquid ink onto the recording medium 2. The printer 1 according to this embodiment includes a recording head 3, a carriage 4 that holds the recording head 3, a carriage moving mechanism 5 that reciprocates the carriage 4 in a main scanning direction, which is a width direction of the recording medium 2, and a paper feeding mechanism 6 that transports the recording medium 2 in a subscanning direction, which intersects the main scanning direction. It should be noted that the ink is a kind of liquid according to the embodiment of the invention and is stored in an ink cartridge 7 (a kind of liquid supply source). The ink cartridge 7 can be detachably attached to the recording head 3. It should be noted that the ink cartridge 7 may be disposed not only on the carriage 4 but also on the body side of the printer 1, and the ink in the ink cartridge 7 may be supplied to the recording head 3 via an ink supply tube.

In the printer 1, a home position, which is a standby position of the carriage 4, is provided on one end side in the main scanning direction of the carriage 4. In the home position, a capping mechanism 9 (a kind of maintenance mechanism according to the embodiment of the invention) is provided. The capping mechanism 9 has a tray-shaped cap 10 (sealing member) that can come into contact with a nozzle surface (nozzle plate 39) on which nozzles 42 (see FIG. 2) of the recording head 3 open. The capping mechanism 9 can come into close contact with the nozzle surface when the nozzles 42 of the recording head 3 are placed on openings of the cap 10 on the upper surface side. The close-contact sealing state between the nozzle surface and the cap 10 defines a sealing cavity in the cap 10. The cap 10 is connected to a pump unit 11. The pump unit 11 includes a suction pump, for example, a tube pump. When the suction pump operates, a negative pressure can be applied to the inside of the sealing cavity. After the suction pump has been operated in the nozzle surface close-contact state and the negative pressure has been applied to the inside of the sealing cavity (enclosed space), the ink and bubbles in the recording head 3 are sucked from the nozzle 42 and discharged into the sealing cavity of the cap 10. In other words, the capping mechanism 9 performs a cleaning operation that is a kind of maintenance operation for forcibly sucking and discharging the ink and bubbles in the ink flow path in the recording head 3.

Figure 2:
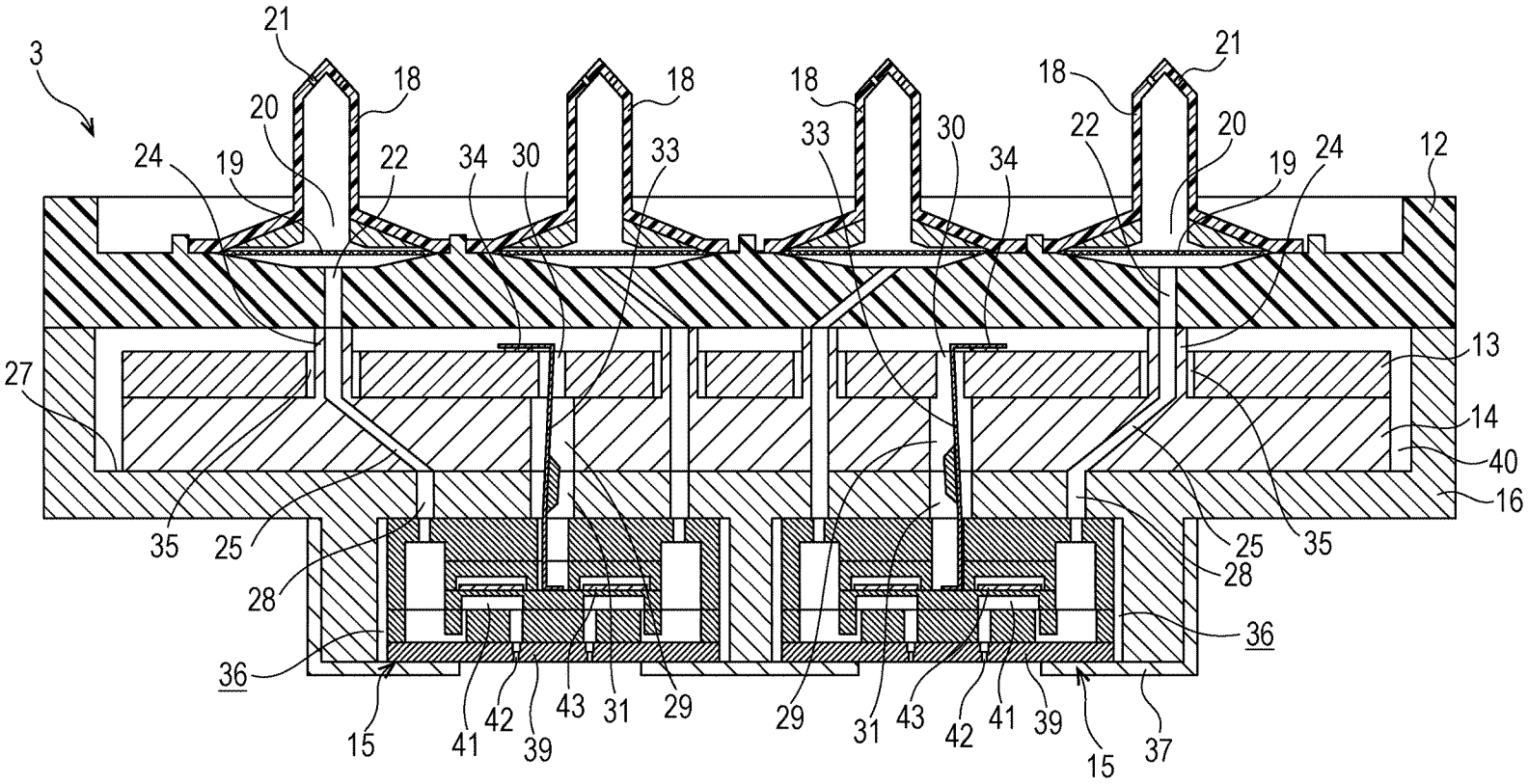
FIG. 2 is a cross-sectional view of a liquid ejecting head (recording head).

FIG. 2 is a cross-sectional view of the recording head 3 according to the embodiment. The recording head 3 according to the embodiment includes an ink introduction member 12, a relay substrate 13, an intermediate flow path member 14, a head unit 15, a holder 16, and other components, which are stacked. In the description below, for convenience, the stacking direction of the components is defined as the up-down direction.

A plurality of ink introduction needles 18 are provided to stand on an upper surface of the ink introduction member 12 with filters 19 therebetween. In this embodiment, the ink introduction member 12 that includes the ink introduction needles 18 corresponds to the liquid introduction member according to the invention. The ink introduction needles 18 are provided for individual inks (colors). The ink introduction member 12 and the ink introduction needles 18 are made of a synthetic resin. The filter 19 is a member that filters an ink introduced by the ink introduction needle 18. For example, the filter 19 is a metal that is woven in a mesh form or is a thin metal plate with many holes. The filter 19 captures foreign matter and bubbles in the ink. In this embodiment, the ink cartridges 7 are attached to the upper surface of the ink introduction member 12, and the ink introduction needles 18 are inserted into the ink cartridges 7 respectively. The ink in the ink cartridge 7 is introduced by ink introduction holes 21, which are provided in a tip portion of the ink introduction needle 18, into an internal flow path. After the ink has been introduced by the ink introduction needle 18, the ink passes through the filter 19 and supply flow path 22 and is supplied to the intermediate flow path member 14, which is disposed below the ink introduction member 12, via a flow path connection section 24. In the ink introduction member 12 according to the embodiment, the ink introduction needles 18 are inserted into the ink cartridges 7 to introduce ink, however, the mechanism is not limited to this example. For example, a so-called foam system may be employed in which a porous material such as a nonwoven fabric or a sponge is provided in the ink introduction sections of the ink introduction member 12 while similar materials are provided in the ink introduction sections of the ink storage members such as the ink cartridges and sub tanks, and the porous material members of the ink introduction member 12 and the ink storage members come into contact with each other to exchange ink by capillary action. In other words, any mechanism that includes an introduction inlet for introducing an ink, a filter for filtering the introduced ink, and a filter chamber having the filter may be employed.

The intermediate flow path member 14 is a substrate that has intermediate flow paths 25 that guide the ink introduced by the ink introduction needles 18 toward the head units 15. On an upper surface of the intermediate flow path member 14, around the peripheral edges of openings of the intermediate flow paths on the inlet side, the cylindrical flow path connection sections 24 are provided in a protruding manner. The height (corresponding to a protrusion length from the upper surface of the intermediate flow path member 14) of the flow path connection section 24 is greater than or equal to the thickness of the relay substrate 13, which is disposed between the ink introduction member 12 and the intermediate flow path member 14. The flow path connection sections 24 communicate with the supply flow paths 22 in the ink introduction member 12 to receive the inks from the ink introduction member 12 and guide the inks to the intermediate flow paths 25. The intermediate flow paths 25 open in a lower surface of the intermediate flow path member 14 and communicate with communication flow paths 28 that are provided in an open manner in a partition plate 27 of a holder 16. The intermediate flow path member 14 has wiring openings 29 that are through-holes provided in the plate thickness direction at positions separated from the intermediate flow paths 25. The wiring openings 29 communicate with wiring insertion ports 30 in the relay substrate 13, which will be described below, and also communicate with wiring through holes 31 that are provided in the partition plate 27 of the holder 16. The wiring openings 29 are spaces into which flexible substrates 33 are inserted.

The relay substrate 13, which is provided between the ink introduction member 12 and the intermediate flow path member 14, is a printed circuit board on which wiring patterns and the like are provided to receive drive signals, discharge data (raster data), and the like from the printer body and supply the drive signals to the piezoelectric elements 43 in the head unit 15 via the flexible substrates 33. On an upper surface (a surface opposite to a lower surface that is on the head unit 15 side) of the relay substrate 13, substrate terminals 34 that are connected to the flexible substrates 33 are provided, and a connector (not illustrated) connected to a flexible flat cable (FFC) provided from the printer body and other electronic components are mounted.

In the relay substrate 13, relief holes 35 into which the flow path connection sections 24 are inserted are provided at positions corresponding to the flow path connection sections 24 of the intermediate flow path member 14. The relief holes 35 are through holes that have an outer diameter slightly larger than that of the flow path connection sections 24. In positions adjacent to the substrate terminals 34 on the relay substrate 13, the wiring insertion ports 30, which are through holes in the substrate thickness direction, are provided in the direction the substrate terminals 34 are provided in parallel. Into the wiring insertion port 30, one end of the flexible substrate 33, which is connected to an element terminal of the piezoelectric element 43 on the other end, is inserted. Inside dimensions of the wiring insertion port 30 according to the embodiment in the lengthwise direction and the widthwise direction are set to dimensions that enable the flexible substrate 33 to be inserted into the wiring insertion port 30 without problems.

In the holder 16, a plurality of accommodating spaces 36 are defined to accommodate the head units 15. Lower surfaces (in the printer 1, a side where the head units 15 face the recording paper 2 during a print operation) of the accommodating spaces 36 open. From the openings, the head units 15, which are bonded to a fixing plate 37, are accommodated. The fixing plate 37 is, for example, a metal plate material of a stainless steel. On the fixing plate 37, nozzle plates 39 of the head units 15 are bonded, which defines a height direction (positions in the direction perpendicular to the nozzle plate 39) of the head units 15. On a surface of the holder 16 higher than the accommodating spaces 36, a substrate mounting section 40 is provided. In the substrate mounting section 40, the intermediate flow path member 14 and the relay substrate 13 are disposed. The substrate mounting section 40 and the accommodating spaces 36 are divided by the partition plate 27. On an upper surface of the partition plate 27, the intermediate flow path member 14 is mounted. The partition plate 27 has the communication flow paths 28 and the wiring through holes 31 which pass through the partition plate 27 in the plate thickness direction. The head units 15 are positioned and accommodated in the accommodating spaces 36 and thereby ink flow paths including nozzles 42 and pressure chambers 41 of the head units 15 communicate with the communication flow paths 28. This structure enables the inks from the ink cartridges 7 introduced by the ink introduction needles 18 to be filtered by the filters 19 and to fill the ink flow paths (correspond to the liquid flow paths according to the present invention) from the supply flow paths 22 through the intermediate flow paths 25 and the communication flow paths 28 to the nozzles 42 of the head units 15.

The head unit 15 according to the embodiment includes the nozzle plate 39 in which the nozzles 42 open, the pressure chambers 41 that communicate with the nozzles 42, and the piezoelectric elements 43 that cause pressure fluctuations in the inks in the pressure chambers 41. The nozzle plate 39 is a plate material in which the nozzles 42 open in line. In this embodiment, the nozzles 42 are arranged in line with pitches corresponding to a dot formation density to form nozzle arrays. The pressure chamber 41 and the piezoelectric element 43 are provided for each nozzle 42. To an electrode terminal (not illustrated) of the piezoelectric element 43, a terminal on one end of the flexible substrate 33, whose the other end is connected to the relay substrate 13, is connected. When the piezoelectric element 43 receives a drive signal (drive voltage) via the relay substrate 13 and the flexible substrate 33, a piezoelectric active part of the piezoelectric element 43 bends and deforms according to the change of the applied voltage, and this bending and deforming causes a flexible surface that defines one surface of the pressure chamber 41 to be displaced in a direction away from or toward the nozzle 42. This displacement causes pressure fluctuations in the ink in the pressure chamber 41, and this pressure fluctuations cause the nozzle 42 to discharge the ink.

Figure 3:
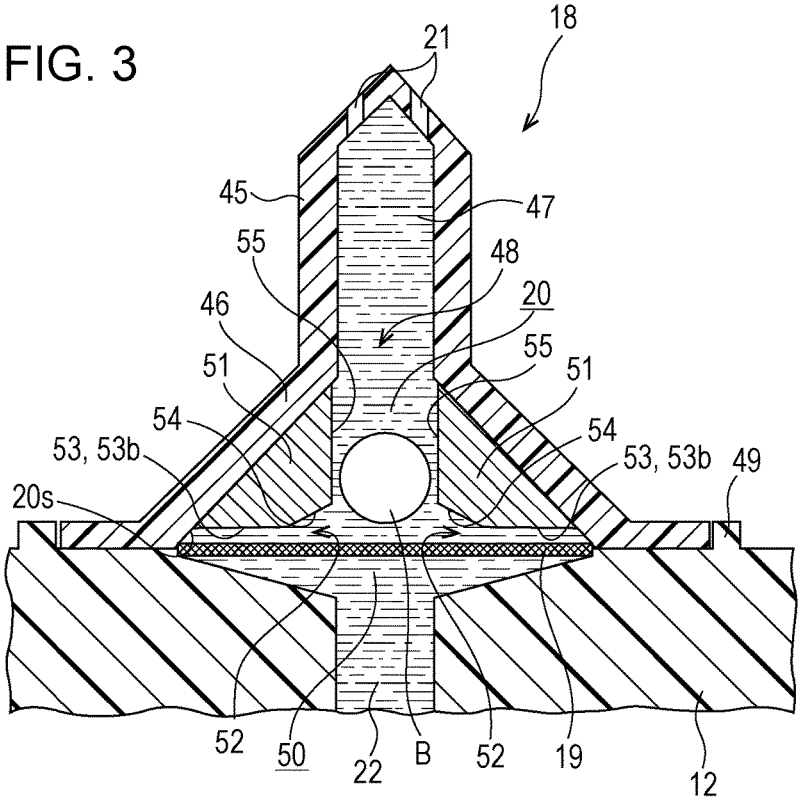
FIG. 3 is a cross-sectional view of an ink introduction needle in a liquid introduction member (ink introduction member).
Figure 4:
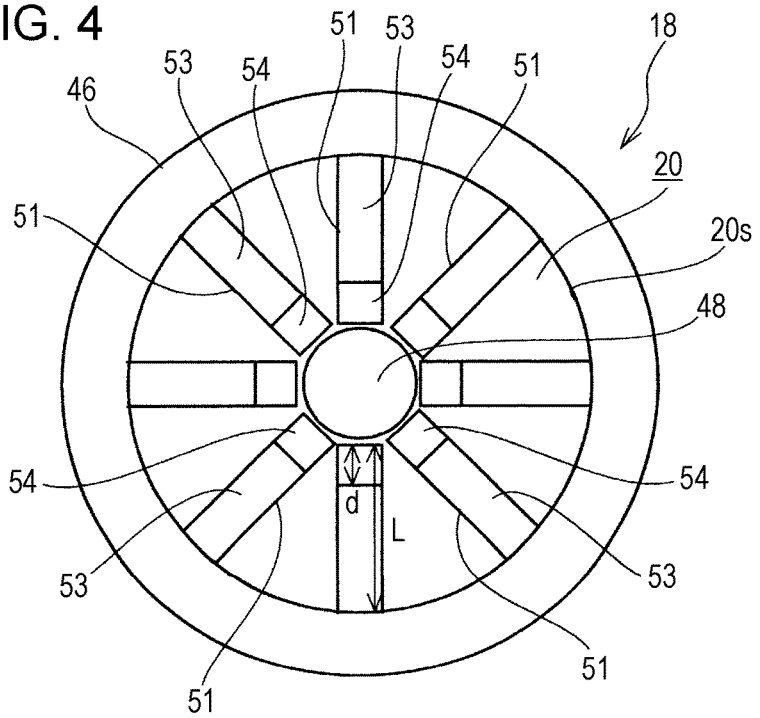
FIG. 4 is a bottom view of the ink introduction needle.

FIG. 3 is a cross-sectional view of the ink introduction needle 18 and components around the ink introduction needle 18 in the ink introduction member 12. FIG. 4 is a bottom view of the ink introduction needle 18. The ink introduction needle 18 according to the embodiment is a hollow needle-shaped member that has an internal space that serves as a needle flow path 47. The ink introduction needle 18 is made of, for example, a synthetic resin. The ink introduction needle 18 has a cylindrical section 45 that has a certain flow-path cross-sectional area and an enlarged diameter section 46 that has a filter chamber 20 in which flow-path cross-sectional areas gradually increase from an upstream side toward a downstream side (filter 19 side).

The cylindrical section 45 is inserted into the ink cartridge 7, and a tip portion of the cylindrical section 45 has a tapered conical shape. The tip portion has a plurality of ink introduction holes 21 that communicate with the outside of the ink introduction needle 18 and the needle flow path 47. As described above, an insertion of the cylindrical section 45 into the ink cartridge 7 enables the ink in the cartridge to be introduced into the needle flow path 47 through the ink introduction holes 21. The filter chamber 20 is continuously defined on the downstream side of the cylindrical section 45 and has a substantially conical shape whose diameters gradually increase from an upstream side (cylindrical section 45 side) toward a downstream side (filter 19 side). The shape and area of an opening on a lower surface side (outlet side) of the filter chamber 20 are substantially the same as the shape and area of the filter 19. The ink, which has been introduced into the needle flow path 47 through the ink introduction holes 21, is introduced into the filter chamber 20 from an inlet 48 that exists between the cylindrical section 45 and the enlarged diameter section 46, and the ink flows toward the filter 19.

An introduction needle mounting frame 49 that surrounds the ink introduction needle 18 is provided on the upper surface of the ink introduction member 12 to which the ink introduction needle 18 is attached, that is, around a peripheral edge portion of an inlet opening of the supply flow path 22. The introduction needle mounting frame 49 has a rectangular shape in cross-sectional view on the upper surface of the ink introduction member 12, and in the introduction needle mounting frame 49, the ink introduction needle 18 is positioned. The periphery of the lower end portion of the enlarged diameter section 46 of the ink introduction needle 18 is surrounded by the introduction needle mounting frame 49 when the ink introduction needle 18 is mounted inside the introduction needle mounting frame 49. A downstream side filter chamber 50 is defined on an inlet side opening section of the supply flow path 22. The downstream side filter chamber 50 has flow-path cross sections, and their diameters gradually increase from the supply flow path 22 side toward the inlet side opening (filter 19 side). The downstream side filter chamber 50 is a portion of the supply flow path 22. The shape and area of the inlet side opening of the downstream side filter chamber 50 are substantially the same as the shape and area of the filter 19. The filter 19 is mounted to block the inlet side opening of the downstream side filter chamber 50. The ink introduction needle 18 is mounted inside the introduction needle mounting frame 49 of the ink introduction member 12, for example, by ultrasonic welding such that the lower surface side opening of the filter chamber 20 faces the filter 19 that has been mounted on the inlet side opening of the downstream side filter chamber 50. This arrangement enables the filter chamber 20 (needle flow path 47) of the ink introduction needle 18 and the supply flow path 22 to communicate with each other with the filter 19 therebetween in a liquid tight state.

In the filter chamber 20, a guide 51 extends from an inner wall surface 20*s* (the side of the outer periphery of the filter 19) of the filter chamber 20 toward the inlet 48 in the surface direction of the filter 19. The guide 51 according to the embodiment is a protrusion that has a substantially triangular rib shape (plate-like shape) in cross-sectional view in an axis direction of the ink introduction needle 18. As illustrated in FIG. 4, a plurality of guides 51 are radially provided at different locations along the inner wall surface 20*s* of the filter chamber 20 and the outer periphery of the inlet 48. An end surface (side surface 55) of the guide 51 on the inlet 48 side is substantially aligned with the opening periphery of the inlet 48 in plan view. A bottom surface 53 of the guide 51, that is, a surface that faces the filter 19, is disposed with a distance from the filter 19 on the upstream side, and the bottom surface 53 and the filter 19 defines a space 52. The bottom surface 53 of the guide 51 has a guide surface 54 that guides bubbles B flowed from the inlet 48 toward the space 52. The guide surface 54 has a shape formed, for example, by chamfering a corner where the bottom surface 53 of the guide 51 and the side surface 55 join. The guide surface 54 is inclined in a direction gradually approaching the filter 19 from the inlet 48 side toward the outer periphery of the filter 19. It is preferable that the angle of inclination of the guide surface 54 to the filter 19 be an angle within the range from 10 to 80 degrees. This is because if the angle of inclination of the guide surface 54 exceeds the upper limit or the lower limit, it is difficult to smoothly guide the bubbles B into the space 52 during a cleaning operation. It is preferable that, in the guide-extending direction, a dimension d of the guide surface 54 be less than half of a dimension L of the bottom surface 53 including the guide surface 54. If the dimension d of the guide surface 54 exceeds half of the dimension L of the bottom surface 53, it is difficult to press the bubbles B against the filter 19 in a portion (hereinafter, referred to as a second area 53*b* as appropriate) of the bottom surface 53 other than the guide surface 54 during a cleaning operation, and the degree of bubble discharging may be decreased.

In this embodiment, the second area 53*b*, which is the portion other than the guide surface 54 of the bottom surface 53, is substantially parallel to the filter 19 and closer to the filter 19 than the guide surface 54. It should be noted that the second area 53*b* may not be exactly parallel to the filter 19, and the second area 53*b* may be a surface inclined more gently than the guide surface 54. In other words, the average distance of distances from the guide surface 54 to the filter 19 in the guide-extending direction is longer than the average distance of distances from the second area 53*b* in the bottom surface 53 in the guide 51 to the filter 19 in the guide-extending direction. The guide 51 having such a structure guides the bubbles B in the filter chamber 20 along the guide surface 54 into the space 52 to spread the bubbles B onto the filter 19 toward the outer periphery of the filter 19 during a cleaning operation, which will be described below. Consequently, this structure increases the degree of bubble discharging during the cleaning operation. Hereinafter, the cleaning operation will be described.

Figure 5:
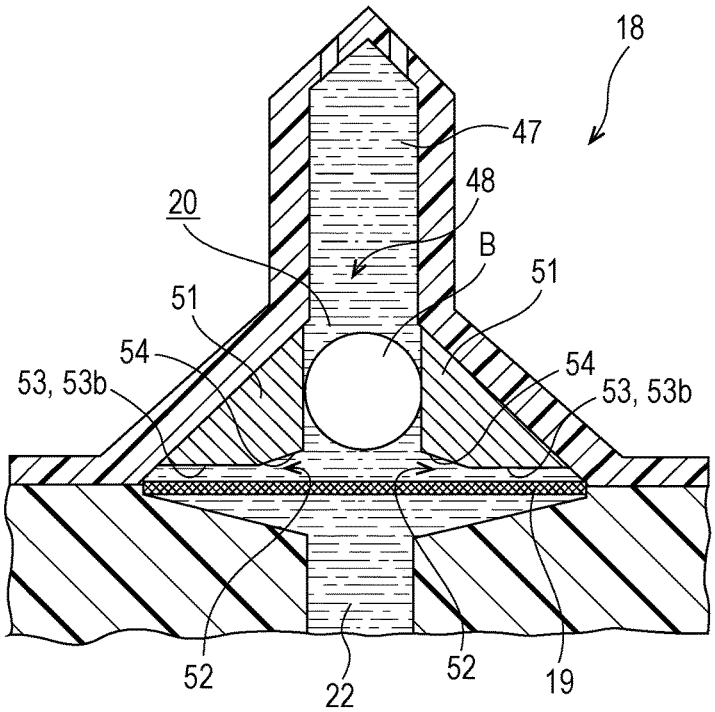
FIG. 5 illustrates a step of discharging bubbles in a maintenance operation.

FIGS. 5 to 8 show bubble discharging steps during the cleaning operation. In the printer 1 of this type, for example, when the ink introduction needle 18 is inserted into or removed from the ink cartridge 7, sometimes bubbles B enter the needle flow path 47. These bubbles B are captured by the filter 19 in the filter chamber 20 and combine with each other into larger ones (FIG. 5). The printer 1 sets the recording head 3 that has been mounted on the carriage 4 to a home position and regularly performs a cleaning operation using the capping mechanism 9 to discharge the bubbles B in the filter chamber 20. In the cleaning operation, a suction pump is actuated in a capped state in which the cap 10 is brought into close contact with the nozzle surface (nozzle plate 39) of the recording head 3 to produce a negative pressure. The negative pressure causes the ink in the ink flow path to flow at a rate faster than the flow rate in the normal recording operation, and using the power of the flowing ink, the bubbles B in the filter chamber 20 are discharged from the nozzle 42 to the outside.

Figure 6:
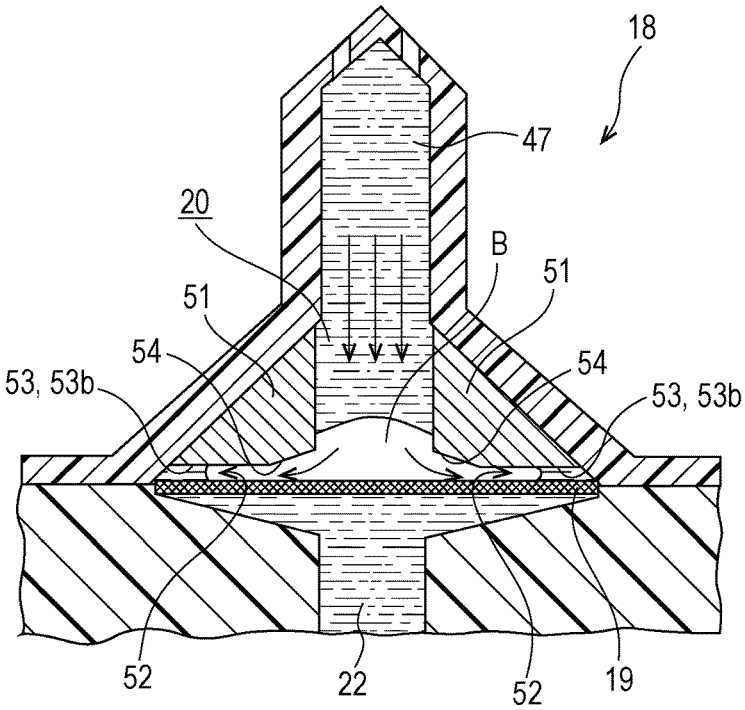
FIG. 6 illustrates a step of discharging the bubbles in the maintenance operation.
Figure 7:
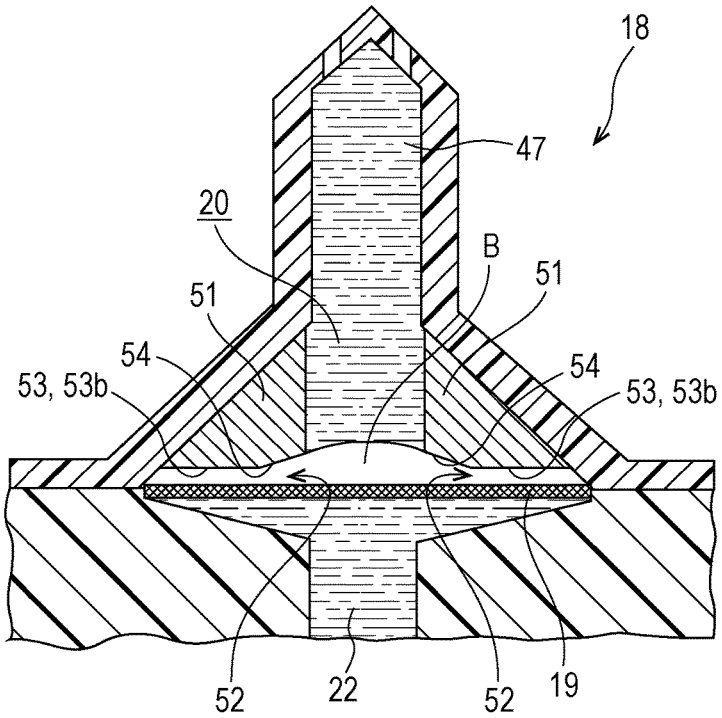
FIG. 7 illustrates a step of discharging the bubbles in the maintenance operation.
Figure 8:
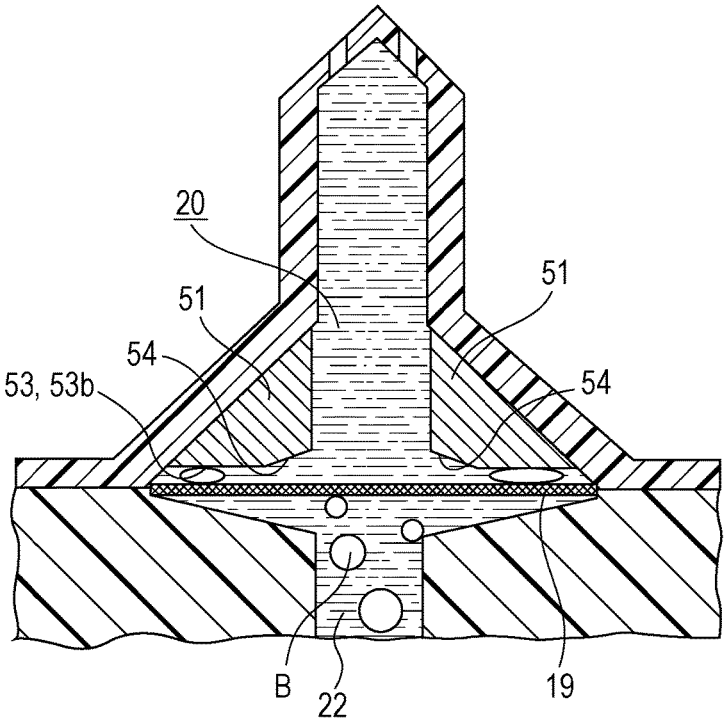
FIG. 8 illustrates a step of discharging the bubbles in the maintenance operation.

As the ink flow rate is increased during the cleaning operation, as shown in FIG. 6, the bubbles B in the filter chamber 20 are pressed against the filter 19 as a result of the ink flowing from the upstream side. A part of the pressed bubbles B is guided by the guide surface 54 of the guide 51 and enters the space 52. The bubbles B in the space 52 are pressed and spread onto the filter 19 toward the outer periphery of the filter 19. Then, as shown in FIG. 7, the bubbles B cover (clog) almost all of the filter 19 and a pressure difference larger than that before the choking is produced between the upstream side and the downstream side with the filter therebetween. The pressure difference causes most of the bubbles B to pass through the filter 19 as shown in FIG. 8. The bubbles B pass through the meshes (holes) of the filter 19 and divided into finer bubbles. The bubbles B that have passed through the filter 19 flow from the supply flow path 22 toward the downstream side (nozzle 42 side) with the flow of the ink, and the bubbles B are discharged from the nozzle 42 into the cap 10.

As described above, the recording head 3 according to the embodiment is provided with the guide 51 that has the guide surface 54 in the filter chamber 20, and this structure increases the degree of bubble discharging during cleaning operation. In other words, the guide 51 can spread the bubbles B onto the filter 19 such that the bubbles B cover the filter 19 during the cleaning operation, which enables the recording head 3 to efficiently discharge the bubbles B in a short time. Accordingly, the printer 1 according to the embodiment can reduce the amounts of inks consumed in one cleaning operation.

Furthermore, in this embodiment, the guides 51 are radially disposed in different locations along the inner wall surface 20*s* of the filter chamber 20 and the outer periphery of the inlet 48. Consequently, the bubbles B can be evenly spread onto the filter 19. This structure further increases the degree of bubble discharging. Furthermore, each guide surface 54 according to the embodiment is inclined in the direction gradually approaching the filter 19 from the inlet 48 side toward the outer periphery of the filter 19. This inclination enables the bubbles B to be guided from the inlet 48 side toward the outer periphery of the filter 19 as a result of the ink flowing from the inlet 48 side. Furthermore, an average distance of the distances from the second area 53*b* in the bottom surface 53 other than the guide surface 54 to the filter 19 is shorter than an average distance of the distances from the guide surface 54 to the filter 19, and this structure enables the bubbles B that have been guided into the space 52 to be pressed against the filter 19. Since the second area 53*b* according to the embodiment is parallel to the filter 19, the bubbles B that have been guided into the space 52 can be evenly pressed against the filter 19. Consequently, the degree of bubble discharging can be further increased.

Figure 9:
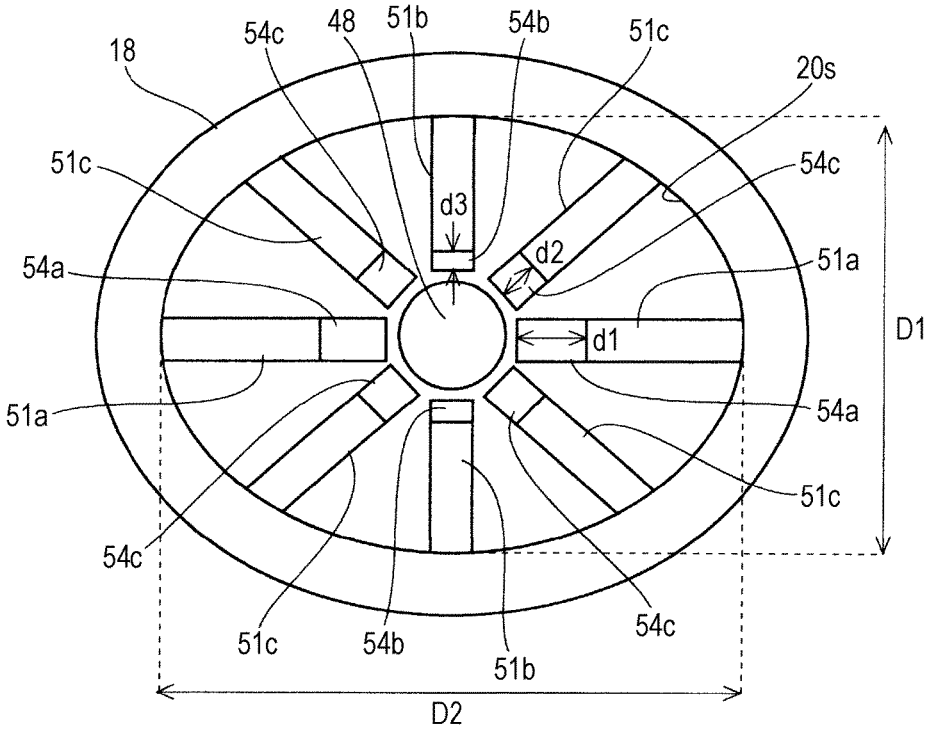
FIG. 9 is a bottom view of an ink introduction needle according to a second embodiment.

FIG. 9 is a bottom view of the ink introduction needle 18 according to a second embodiment. In the first embodiment, the shape of the filter 19 and the shape (the flow-path cross-sectional view in the surface direction of the filter 19) of the filter chamber 20 viewed from the lower surface side are substantially true circles, however, the shapes are not limited to these examples. In the second embodiment, the filter 19 has an elliptical shape and the filter chamber 20 has an elliptical cross-sectional shape correspondingly. In other words, an inner diameter D1 in one direction (the longitudinal direction in FIG. 9) of a lower surface opening of the filter chamber 20 is shorter than an inner diameter D2 in a direction (the lateral direction in FIG. 9) that is orthogonal to the one direction. The structure in which the filter 19 and the filter chamber 20 have the elliptical shapes results in differences in distances between the inlet 48 to the outer periphery of the filter 19, and often bubbles are unevenly spread on the filter 19. To address the problem, in this embodiment, in the surface direction of the filter 19, dimensions of the guide surfaces 54 in the direction the guides 51 extend are larger (longer) in the guides 51 that are disposed at locations on the inner wall surface 20*s* of the filter chamber 20 where distances to the inlet 48 are longer. On the other hand, dimensions of the guide surfaces 54 in the direction the guides 51 extend are smaller (shorter) in the guides 51 that are disposed at locations on the inner wall surface 20*s* where distances to the inlet 48 are shorter (or no guide surfaces 54 are provided). That is, in the example in FIG. 9, the dimension d1 of the guide surface 54*a* in the guide 51*a* that extends in the lateral direction (the direction along the inner diameter D2 of the filter chamber 20) of the filter 19 is longest, and the dimension d3 of the guide surface 54*b* in the guide 51*b* that extends in the longitudinal direction (the direction along the inner diameter D1 of the filter chamber 20) of the filter 19 is shortest. The dimension d2 of the guide surface 54*c* in the guide 51*c* that is disposed between the guide 51*a* and the guide 51*b* has a length between the dimension d1 and the dimension d3. In this structure, the guide surfaces 54 have the same inclination angle. It should be noted that the inclination angles of the guide surfaces 54 may be different angles as long as the above-described conditions are satisfied. The other structures are similar to those in the first exemplary embodiment.

With the structure according to the embodiment, the guides 51 that are disposed at the locations on the inner wall surface 20*s* where the distances to the inlet 48 are longer have larger dimensions in the guide surfaces 54 in the direction the guides 51 extend. Accordingly, during the cleaning operation, bubbles can easily enter the spaces 52 between the guides 51, which have larger dimensions, and the filter 19. Consequently, the bubbles can be evenly spread onto the filter 19. As a result, the degree of bubble discharging can be increased.

Figure 10:
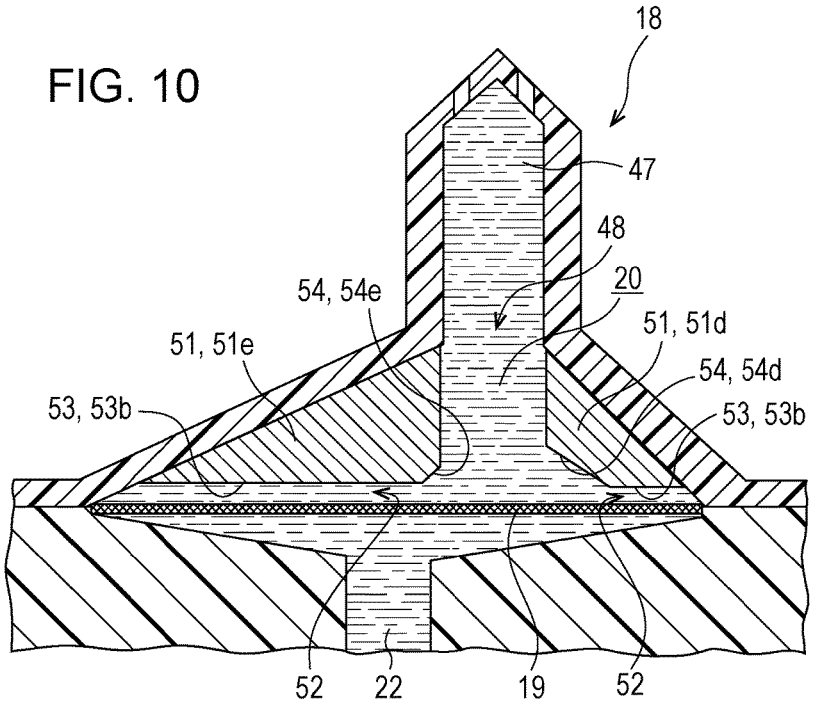
FIG. 10 is a cross-sectional view of an ink introduction needle according to a third embodiment.
Figure 11:
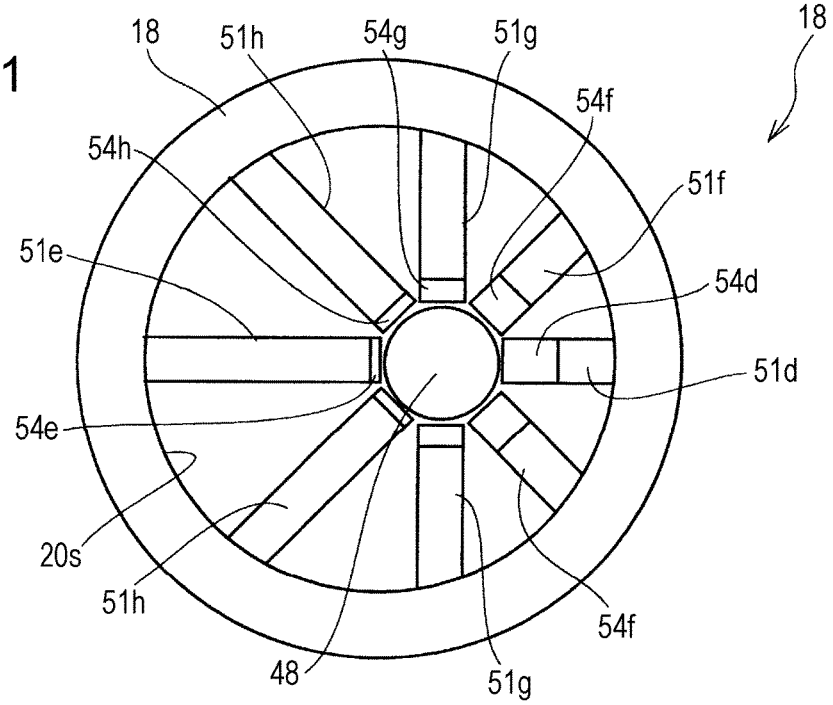
FIG. 11 is a bottom view of the ink introduction needle according to the third embodiment.

FIGS. 10 and 11 illustrate a structure of the ink introduction needle 18 according to a third embodiment of the invention, in which FIG. 10 is a cross-sectional view, and FIG. 11 is a bottom view. This embodiment is different from the above-described embodiments in that the inlet 48 is off-centered to one side (the right side in FIG. 10) with respect to a central part of the filter 19. During a cleaning operation, such a structure relatively increases the flow rate on the side where the inlet 48 is off-centered in the filter chamber 20, whereas relatively decreases the flow rate on the side (the left side in FIG. 10) where is opposite to the side the inlet 48 is off-centered and the ink tends to stagnate. In this structure, bubbles tend to stay on the side opposite to the side the inlet 48 is off-centered. To address the problem, in this embodiment, in the surface direction of the filter 19, dimensions of the guide surfaces 54 in the guide-extending direction are larger in the guides 51 that are disposed at locations on the inner wall surface 20*s* where distances to the inlet 48 are shorter. On the other hand, dimensions of the guide surfaces 54 in the guide-extending direction are smaller in the guides 51 that are disposed at locations on the inner wall surface 20*s* where distances to the inlet 48 are longer (or no guide surfaces 54 are provided). In other words, according to the embodiment illustrated in FIGS. 10 and 11, in the filter chamber 20, the dimension of the guide surface 54*d* in the guide-extending direction in the guide 51*d*, which is disposed on the side where the inlet 48 is off-centered with respect to the filter 19, is largest. On the other hand, the dimension of the guide surface 54*e* in the guide-extending direction in the guide 51*e*, which is disposed on the opposite side of the guide 51*d* to the inlet 48, is shortest. The dimensions of the guide surfaces 54*f* to 54*h* in the guides 51*f* to 51*h*, which are disposed between the guides 51*d* and 51*e* on the inner wall surface 20*s*, are between the dimensions of the guide surfaces 54*d* and 54*e*, and the dimensions decrease in the order of the guide surfaces 54*f*, 54*g*, and 54*h*. The other structures are similar to those in the first embodiment. The inclination angles of the respective guide surfaces 54 are similar to those in the second embodiment.

In the structure according to this embodiment, the dimensions of the guide surfaces 54 in the guide-extending direction are larger in the guides 51 that are disposed at the locations on the inner wall surface 20*s* of the filter chamber 20 where the distances to the inlet 48 are shorter. Consequently, during the cleaning operation, this structure enables bubbles to enter the spaces 52 between the guides 51 that are disposed at the locations on the inner wall surface 20*s* where distances to the inlet 48 are shorter, and prevents the bubbles from collecting in areas where the flow tends to stagnate on the side opposite to the side where the inlet 48 is off-centered with respect to the filter 19. As a result, the degree of bubble discharging can be increased.

Figure 12:
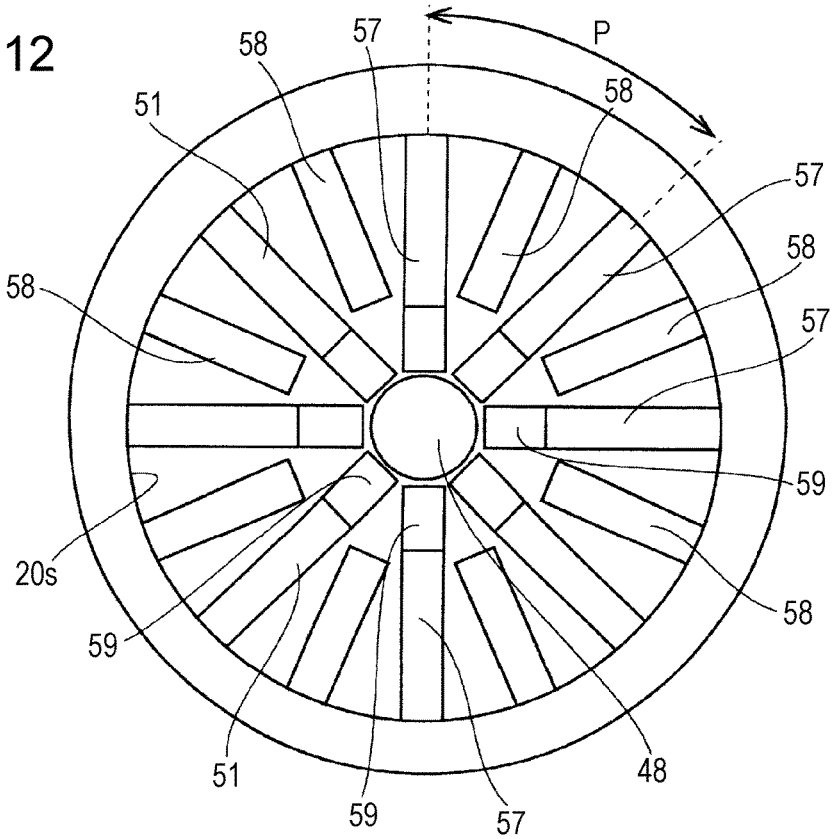
FIG. 12 is a bottom view of an ink introduction needle according to a fourth embodiment.
Figure 13:
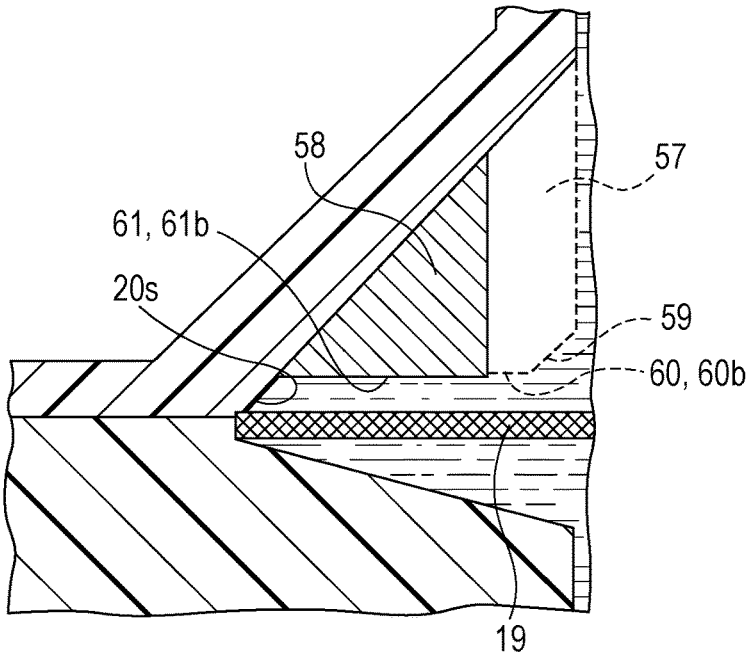
FIG. 13 is a partial cross-sectional view of the ink introduction needle according to the fourth embodiment.

FIGS. 12 and 13 illustrate a structure of the ink introduction needle 18 according to a fourth embodiment of the invention, in which FIG. 12 is a bottom view, and FIG. 13 is a partial cross-sectional view. In FIG. 13, a guide 57 is indicated by the broken line. In this embodiment, the filter 19 is larger in size than that in the first embodiment, and the cross-sectional area of the filter chamber 20 is enlarged correspondingly. In other words, the cross-sectional area of the filter chamber 20 is increased compared with flow-path cross-sectional areas of the other portions in the ink flow path. In such a structure, distances P between adjacent guides 57 on the inner wall surface 20*s* in the filter chamber 20 are further increased, and spaces (spaces that have the shape of substantially a sector in plan view and defined by the adjacent guides 57 and the inner wall surface 20*s* therebetween) where no guides 57 are provided in the filter chamber 20 are increased correspondingly. On the other hand, the guides 57 are so closely disposed around the periphery of the inlet 48 that it is difficult to add the guides 51 that have a similar size between the guides 57.

As described above, the increase in size of the spaces where no guides 57 are provided in the filter chamber 20 may prevent bubbles in these areas from coming into close contact with the filter 19 due to the buoyancy of the bubbles and decrease the degree of bubble discharging. The spaces may be narrowed by providing the guides 57 of a shape of a sector in plan view, however, in such a case, the ink flow between the bottom surfaces of the guides 57 and the filter 19 may be reduced and the pressure loss may be increased, and thereby the ink supply may be interrupted. To address the problem, in this embodiment, relatively long guides 57 that extend from the inner wall surface 20*s* to the peripheral edge of the inlet 48 are provided as first guides 57, and between the first guides 57 that are adjacent to each other in the peripheral direction of the inner wall surface 20*s*, second guides 58 that are relatively shorter in the dimension in the guide-extending direction than that of the first guides 57 are provided. The first guide 57 has a guide surface 59 that is similar to the guide surface 54. On the other hand, the second guides 58 have no guide surfaces. With this structure, bubbles guided by the guide surfaces 59 of the first guides 57 into the spaces between the filter 19 are evenly pressed by the filter 19.

In the structure according to this embodiment, when bubbles are spread onto the filter 19, the second guides 58 press the bubbles together with the first guides 57 toward the filter 19, and the bubbles can be evenly spread onto the filter 19, and as a result, the degree of bubble discharging can be increased. Furthermore, as illustrated in FIG. 13, in the direction that is orthogonal to the filter 19, a bottom surface 61 of the second guide 58 is aligned with a bottom surface 60 of the first guide 57. In other words, the bottom surfaces 61 of the second guides 58 are not closer to the filter 19 than the bottom surfaces 60 of the first guides 57 and the distances from the bottom surfaces 61 of the second guides 58 to the filter 19 are not too long. With this structure, when bubbles are spread onto the filter 19, the second guides 58 can be prevented from interfering the movement of the bubbles, and the bubbles can be prevented from floating from the filter 19, and thereby the bubbles can be evenly spread onto the filter 19. As a result, the degree of bubble discharging can be increased. The other structures are similar to those in the first embodiment. The inclination angles of the respective guide surfaces 54 are similar to those in the second embodiment.

Figure 14:
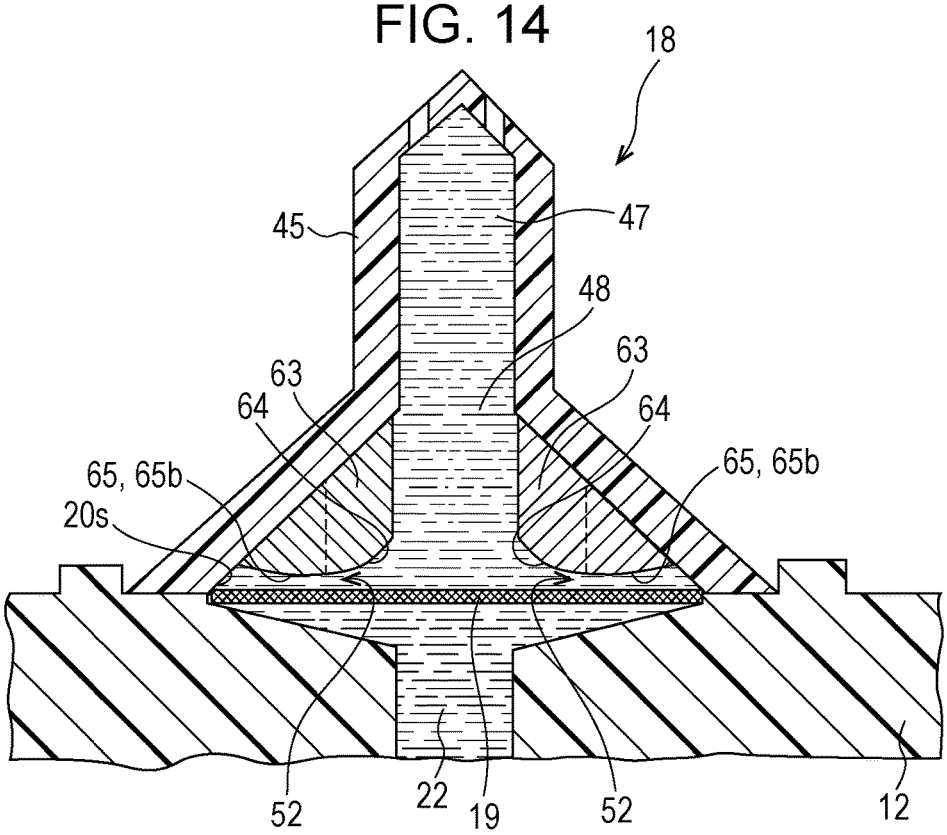
FIG. 14 is a cross-sectional view of an ink introduction needle according to a fifth embodiment.

FIG. 14 is a cross-sectional view of the ink introduction needle 18 according to a fifth embodiment. A guide 63 according to the embodiment is different from the guides according to the above-described embodiments in that the entire bottom surface 65 including a guide surface 64 is a curved surface. In this embodiment, a part closest to the filter 19 (a part where the distance to the filter 19 is closest) in the bottom surface 65 is defined as a border (the broken line in FIG. 14), a side close to the inlet 48 is defined as a guide surface 64, and a side close to the inner wall surface 20*s* of the filter chamber 20 is defined as a second area 65*b*. The average curvature of the guide surface 64 is larger than the average curvature of the second area 65*b*. The second area 65*b* is curved such that distances to the filter 19 are increased from the border toward the inner wall surface 20*s*. The bottom surface 65, which is the curved surface, of the guide 63 including the guide surface 64 has no angular portions, and can smoothly guide bubbles into the spaces 52 between the bottom surfaces 65 and the filter 19. Furthermore, the distances between the second area 65*b* and the filter 19 on the inner wall surface 20*s* side are wider than those on the side of the boundary of the guide surface 64. Accordingly, once a bubble is spread onto the filter 19 toward the inner wall surface 20*s* side, a portion of the bubble on the inner wall surface 20*s* side does not easily move from the space 52 between the second area 65*b* and the filter 19 toward the inlet 48 side (the central side of the filter 19). Accordingly, during the cleaning operation, the bubbles can continue covering the filter 19, and thereby the degree of bubble discharging can be increased. The other structures are similar to those in the first embodiment.

Figure 15:
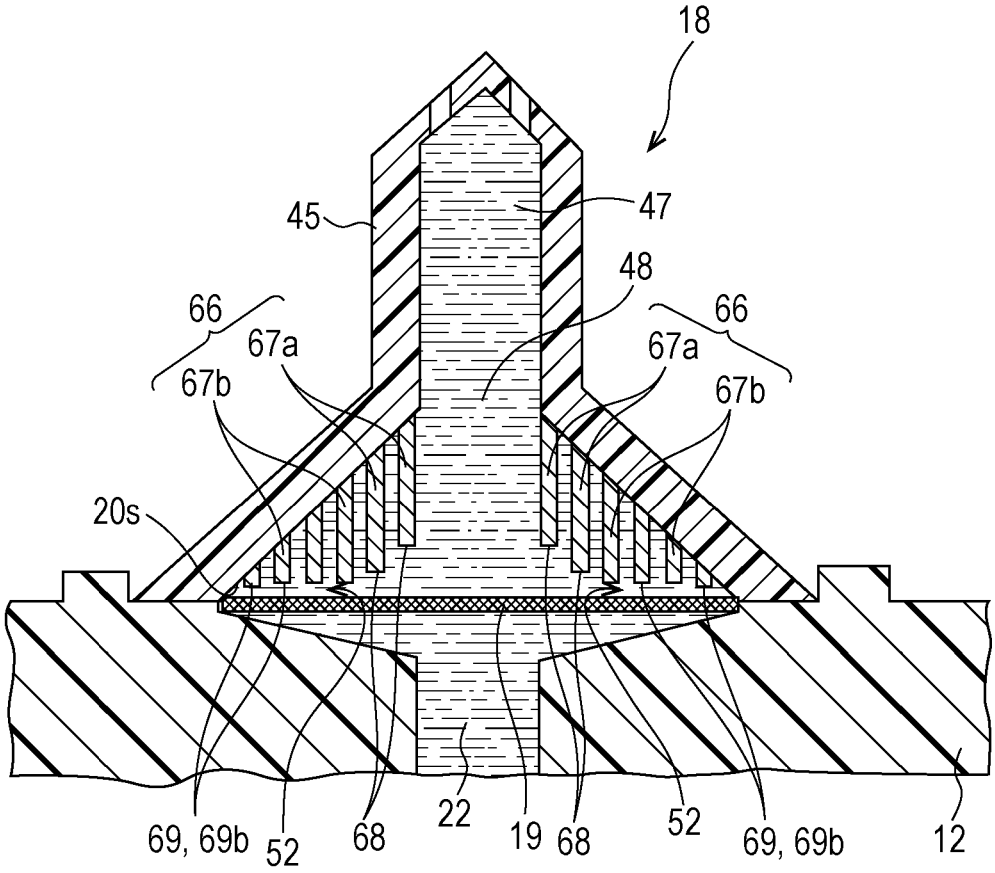
FIG. 15 is a cross-sectional view of an ink introduction needle according to a sixth embodiment.

FIG. 15 is a cross-sectional view of the ink introduction needle 18 according to a sixth embodiment. The guides are not limited to the plate-shaped guides described in the above-described embodiments. In this embodiment, pin-shaped guide pins 67 protrude from the inner wall surface 20*s* of the filter chamber 20 toward the filter 19. In the surface direction of the filter 19, the guide pins 67 are arranged in parallel from the inner wall surface 20*s* side of the filter chamber 20 toward the inlet 48 side. The parallelly arranged guide pins 67 form a single guide 66. Tip surfaces of the guide pins 67 that face the filter 19 form a bottom surface 69 of the guide 66. In this embodiment, among the guide pins 67, distances from the two guide pins 67*a* that are located on the inlet 48 side to the filter 19 are longer than distances from the other guide pins 67*b* to the filter 19, and the distances to the filter 19 increase as the guide pins 67 become closer to the inlet 48. The tip surfaces of the guide pins 67*a* form a guide surface 68 of the guide 66. With this structure, during the cleaning operation, the guide surface 68 guides bubbles into the space 52 to spread the bubbles onto the filter 19, and thereby the degree of bubble discharging can be increased. In other words, a bottom surface or guide surface of a guide can be formed using a plurality of dots or surfaces. The other structures are similar to those in the first embodiment.

In the above-described embodiments, the inkjet recording head 3 has been described as an example of the liquid ejecting head, however, the present invention can be applied to other liquid ejecting heads. For example, the liquid ejecting head of the invention may be color material ejecting heads used for manufacturing color filters for liquid crystal displays and the like, electrode material ejecting heads used for forming electrodes for organic EL displays and FEDs, and bioorganic compound ejecting heads used for manufacturing biochips (biochemical elements). The color material ejecting heads for manufacturing displays eject, as example liquids, solutions of coloring materials of red (R), green (G), and blue (B). The electrode material ejecting heads for electrode forming apparatuses eject, as example liquids, a liquid electrode material, and the bioorganic compound ejecting heads for chip manufacturing apparatuses eject, as an example liquid, a solution of bioorganic compounds.

The entire disclosure of Japanese Patent Application No. 2016-057129, filed Mar. 22, 2016 is expressly incorporated by reference herein.

What is claimed is:

1. A liquid ejecting head, comprising:

an inlet into which a liquid is introduced;

a filter configured to filter the liquid introduced from the inlet;

a filter chamber of which cross-sectional areas increase from the inlet side to the filter side, the filter chamber has at least one guide extending from an inner wall surface of the filter chamber toward the inlet with a space between the guide and the filter, a bottom surface of the guide has a guide surface to guide bubbles which have entered from the inlet, and the guide guides the bubbles into the space by use of the guide surface to spread the bubbles onto the filter toward an outer periphery of the filter;

a liquid flow path to which the liquid that has passed through the filter is supplied; and a nozzle from which the liquid from the liquid flow path is ejected.

2. The liquid ejecting apparatus according to claim 1, wherein the guide surface is inclined so that the space between the guide and the filter decreases toward the outer periphery of the filter from the inlet side, and an average distance between the guide surface and the filter in the guide-extending direction is larger than an average distance between an area other than the guide surface in the bottom surface of the guide and the filter in the guide-extending direction.

3. The liquid ejecting head according to claim 2, wherein the area other than the guide surface in the bottom surface of the guide is parallel to the filter.

4. A liquid ejecting apparatus comprising:
the liquid ejecting head according to claim 3; and
a maintenance mechanism for discharging the liquid and bubbles from the nozzle of the liquid ejecting head.

5. A liquid ejecting apparatus comprising:
the liquid ejecting head according to claim 2; and
a maintenance mechanism for discharging a liquid and bubbles from the nozzle of the liquid ejecting head.

6. The liquid ejecting head according to claim 1, wherein a plurality of the guides are disposed at different locations along a peripheral edge of the inlet.

7. The liquid ejecting head according to claim 6, wherein the guides include first guides and second guides, the length of the first guide in the guide-extending direction is longer than the second guide, and
the second guides are disposed between the adjacent first guides.

8. The liquid ejecting head according to claim 7, wherein the locations of the bottom surfaces of the second guides are aligned with the locations of the bottom surfaces of the first guides in a direction orthogonal to the filter.

9. A liquid ejecting apparatus comprising:
the liquid ejecting head according to claim 8; and
a maintenance mechanism for discharging the liquid and bubbles from the nozzle of the liquid ejecting head.

10. A liquid ejecting apparatus comprising:
the liquid ejecting head according to claim 7; and
a maintenance mechanism for discharging the liquid and bubbles from the nozzle of the liquid ejecting head.

11. The liquid ejecting head according to claim 6, wherein the filter has an elliptical shape, and
dimensions of the guide surfaces in the guide-extending direction are larger in the guides disposed on the inner wall surface where the distances to the inlet are longer.

12. A liquid ejecting apparatus comprising:
the liquid ejecting head according to claim 11; and
a maintenance mechanism for discharging the liquid and bubbles from the nozzle of the liquid ejecting head.

13. The liquid ejecting head according to claim 6, wherein the inlet is off-centered with respect to a central part of the filter, and
dimensions of the guide surfaces in the guide-extending direction are larger in the guides disposed on the inner wall surface where the distances to the inlet are shorter.

14. A liquid ejecting apparatus comprising:
the liquid ejecting head according to claim 13; and
a maintenance mechanism for discharging the liquid and bubbles from the nozzle of the liquid ejecting head.

15. A liquid ejecting apparatus comprising:
the liquid ejecting head according to claim 6; and
a maintenance mechanism for discharging the liquid and bubbles from the nozzle of the liquid ejecting head.

16. A liquid ejecting apparatus comprising:
the liquid ejecting head according to claim 1; and
a maintenance mechanism for discharging the liquid and bubbles from the nozzle of the liquid ejecting head.

* * * * *